United States Patent [19]

Sheetz

[11] Patent Number: 4,888,090

[45] Date of Patent: Dec. 19, 1989

[54] ETCHANT FOR ALUMINUM CONTAINING SURFACES AND METHOD

[75] Inventor: Nicholas J. Sheetz, Chester, Pa.

[73] Assignee: Pennwalt Corporation, Philadelphia, Pa.

[21] Appl. No.: 680,120

[22] Filed: Dec. 10, 1986

[51] Int. Cl.[4] ..... B44C 01/22; C09K 13/02

[52] U.S. Cl. ..... 156/665; 252/79.5

[58] Field of Search ..... 252/79.5, 79.1; 156/665, 664; 34/2, 29; 148/6, 437

[56] References Cited

U.S. PATENT DOCUMENTS

| | | | |
|---|---|---|---|
| 3,293,148 | 12/1966 | Dell et al. | 252/79.5 X |
| 3,481,877 | 12/1969 | Moll | 252/79.5 |
| 3,810,797 | 5/1974 | Schaffstall | 252/79.5 X |
| 4,477,290 | 10/1984 | Carroll et al. | 156/665 X |

FOREIGN PATENT DOCUMENTS

| | | | |
|---|---|---|---|
| 17716852 | 2/1972 | Fed. Rep. of Germany | 252/79.5 |
| 2376222 | 9/1978 | France | 252/79.5 |
| 1160945 | 8/1969 | United Kingdom | 252/79.5 |

*Primary Examiner*—Raymond Hoch

[57] ABSTRACT

A stable aqueous etchant for aluminum containing surfaces and method of etching such surfaces.

5 Claims, No Drawings

ETCHANT FOR ALUMINUM CONTAINING SURFACES AND METHOD

BACKGROUND OF THE INVENTION

This invention relates to the treatment of the surfaces of aluminum and its alloys for cleamning and/or etching purposes. After such treatment, such surfaces may be subjected to further processing such as the formation of a chemical conversion coating or anodic treatment or the like.

It is known to use aqueous alkali solutions to clean and/or etch the sufaces of aluminum and its alloys. In many cases, however, such etching of the aluminum surfaces produces an undesirable precipitate in the solutions. The precipitate tends to mar the aluminum surface and interfere with processing treatments thereafter. Various attempts have been made to overcome this problem such as with the inclusion of gluconates or tartrates in the solutions, including those containing tertiary amino-alcohols and solvents. Such procedure have met with limited success.

Another problem is that the etch rate is customarily too fast which results in a large consumption of the etchant as the etched aluminum surface cannot be isolated from the etch bath rapidly.

The etchant and etching method of this invention provides a relatively inexpensive etchant that has a relatively low consumption rate when compared to other systems. Such lowered etchant rate produces an appreciable reduction in the consumptin of the etchant.

A typical etchant of the prior art is that such as described in British Patent Specification No. 1,160,945 published Aug. 6, 1969, by Amchem Products, Inc. It is thus seen with the British patent specification disclosure that the etchant concentrate there includes an alkali hydroxide, the gluconate ion, ethylene glycol or a derivative thereof and an ethanol amine or a derivative thereof-all in specified proportions to provide a consolute aqueous concentrate.

The etchant of the present invention provides an etchant with a consumption rate similar to that of the etchant of the British patent specification but at a far reduced cost of materials.

SUMMARY OF THE INVENTION

The etchant of the present invention is defined as a stable consolute aqueous etchant for aluminum containing surfaces consisting essentially of, per 100 parts by weight:

(a) from 15 to 40 parts of an alkali metal hydroxide;
(b) at least 0.2 parts of an alkali metal gluconate;
(c) from about 0.01 to 0.05 parts of ethylene glycol, propylene glycol or hexylene glycol; and
(d) the remainder water.

It is preferred that the gluconate be present in an amount of from 0.2 parts to about 10 parts and it is preferred that the alkali metal hydroxide be sodium hydroxide.

The preferred glycol is propylene glycol that is preferably present in the amount of from about 0.01 parts to less than about 0.03 parts.

The method of the present invention is defined as a method for etching aluminum containing surfaces which comprises immersing the surface in an etchant solution heated to a temperature of at least 125° F. for a time period of at least 10 seconds, said etchant solution consisting essentially of at least 90 volume percent water and from 3 to 10 volume percent of an etchant consisting essentially of, per 100 parts by weight of said etchant:

(a) from 15 to 40 parts of an alkali metal hydroxide;
(b) at least 0.2 parts of an alkali metal gluconate;
(c) from about 0.01 to 0.05 parts of ethylene glycol, propylene glycol or hexylene glycol; and
(d) the remainder water.

The term "consolute" means that the concentrate must be homogenous to the exclusion of phase separation as a two phase concentrate is difficult to meter satisfactorily. "Stable" means that the concentrate must retain its homogenity when slowly heated within a temperature range of about 65° through 120° F. A concentrate which is not this stable tends to separate into an objectionable two phase solution during storage and transport.

The term "aluminum containing surfaces" includes any surface containing aluminum or alloys of aluminum.

If the etch rate is reduced by reducing the concentration of the alkali, the ability of the etching bath to hold sodium aluminate in solution is reduced and it therefore becomes necessary to discard the etching bath more frequently. By using the glycol in very small amounts as above stated the etch rate is significantly reduced.

DETAILED DESCRIPTION OF THE INVENTION

The following three etchants are prepared:

| | | % by weight |
|---|---|---|
| ETCHANT #1 | Water | 48.000 |
| | Sodium Gluconate | 3.600 |
| | Sodium Hydroxide Solution (50%) | 48.400 |
| ETCHANT #2 | Water | 47.975 |
| | Sodium Gluconate | 3.600 |
| | Propylene Glycol | 0.025 |
| | Sodium Hydroxide Solution (50%) | 48.400 |
| ETCHANT #3 | Water | 47.985 |
| | Sodium Gluconate | 3.600 |
| | Propylene Glycol | 0.015 |
| | Sodium Hydroxide Solution (50%) | 48.400 |

Etchant baths of each of the three etchants were prepared using each of the etchants 1-3 at 5.0% by volume. The baths were heated to 140° F. and aluminum alloy coupons of 3003 alloy were etched for 15 seconds. The etch cycle was as follows:

1. Weigh coupon and record weight
2. Etch for 15 seconds at 140° F.
3. Rinse in overflowing rinse at 75°-80° F.
4. Desmut for 1 minute
5. Rinse as in step 3
6. Dry coupon with an air gun
7. Weigh coupon and record weight In the above cycle Etchant 1 removed 0.967% of the metal
Etchant 2 removed 0.778% of the metal
Etchant 3 removed 0.790% of the metal.

The examples illustrated below in Tables I and II compare the effect of the glycol level with a commercially available etchant sold under the trademark AMCHEM 5354 that is believed to incorporate the ingredients as set forth in British patent specification 1,160,945, mentioned above. From the examples set forth below in Tables I and II it is thus apparent that as the propylene glycol or hexylene glycol level increases, at some point the retardation effect of the glycol is diminshed.

As illustrated below Table II shows the effect of replenishment of the original etchant concentration. It is noted that the etch rate increases during this process because the caustic soda portion of the etchant is consumed during the etching process but the glycol is not consumed and, in effect, the glycol concentration increases with replenishment of the bath. A similar effect is noted with the competitive etchant, and it is apparent that the relative difference between the two etchants remained quite similar throughout the test.

TABLE I

Effect of Propylene Glycol on Aluminum Weight Loss
Concentration - 5% by Volume
Temperature - 140° F.
Time - 15 seconds

| Solution | Weigh Loss (%) |
|---|---|
| Amchem 5354 | 0.715 |
| Etchant #1 above | 0.860 |
| Etchant #1 above + 0.1% Propylene Glycol | 1.180 |
| Etchant #1 above + 0.025% Propylene Glycol | 0.778 |
| Etchant #1 above + 0.015% Propylene Glycol | 0.746 |
| Etchant #1 above + 0.015% Hexylene Glycol | 0.820 |

TABLE II

Effect of Aging and Replenishment on Aluminum Weight Loss
Concentration - 5% by Volume
Temperature - 140° F.
Time - 15 seconds

| | Weight Loss (%) | |
|---|---|---|
| Bath Condition | Achem 5354 | Etchant #1 above + 0.15% Propylene Glycol |
| Fresh bath | 0.791 | 0.847 |
| After aging and replenishment | 1.1597 | 1.2361 |
| After further aging | 0.964 | 1.029 |
| After additional replenishment | 1.192 | 1.229 |

I claim:

1. A method for etching aluminum containing surfaces which comprises immersing the surface in an etchant solution heated to a temperature of at least 125° F. for a time period of at least 10 seconds, said etchant solution consisting essentially of at least 90 volume percent water and from 3 to 10 volume percent of an etchant consisting essentially of, per 100 parts by weight of said etchant:

(a) from 15 to 40 parts of an alkali metal hydroxide;
(b) at least 0.2 parts of an alkali metal gluconate;
(c) from about 0.01 to 0.05 parts of ethylene glycol, propylene glycol or hexylene glycol; and
(d) the remainder water.

2. The method as defined in claim 1 wherein in (b) the alkali metal gluconate is present in an amount of from 0.2 parts to about 10 parts.

3. The method as defined in claim 2 wherein in (a) the alkali metal hydroxide is sodium hydroxide.

4. The method as defined in claim 3 wherein in (c) the glycol is propylene glycol and is present in the amount of from about 0.01 parts to less than about 0.03 parts.

5. The method as defined in claim 1 wherein in (c) the glycol is propylene glycol.

* * * * *